US010857408B2

(12) United States Patent
Miri-Ghomizadeh

(10) Patent No.: US 10,857,408 B2
(45) Date of Patent: Dec. 8, 2020

(54) BODY ROLLER SLEEVE

(71) Applicant: Fariba Miri-Ghomizadeh, San Carlos, CA (US)

(72) Inventor: Fariba Miri-Ghomizadeh, San Carlos, CA (US)

( * ) Notice: Subject to any disclaimer, the term of this patent is extended or adjusted under 35 U.S.C. 154(b) by 32 days.

(21) Appl. No.: 16/214,104

(22) Filed: Dec. 9, 2018

(65) Prior Publication Data

US 2019/0175977 A1 Jun. 13, 2019

Related U.S. Application Data

(60) Provisional application No. 62/596,958, filed on Dec. 11, 2017.

(51) Int. Cl.
*A63B 21/055* (2006.01)
*A63B 21/00* (2006.01)
(Continued)

(52) U.S. Cl.
CPC ..... *A63B 21/0557* (2013.01); *A61H 15/00* (2013.01); *A63B 1/00* (2013.01); *A63B 21/00185* (2013.01); *A61H 2015/0014* (2013.01); *A61H 2201/0153* (2013.01); *A61H 2201/0173* (2013.01); *A61H 2201/0192* (2013.01); *A61H 2201/1261* (2013.01); *A61H 2201/164* (2013.01); *A61H 2201/169* (2013.01);
(Continued)

(58) Field of Classification Search
CPC . A63B 21/0557; A63B 1/00; A63B 21/00185; A61H 15/00; A61H 2201/1623; A61H 2201/164; A61H 2205/06; A61H 2201/0192; A61H 2205/10; A61H 2201/1671; A61H 2201/0153; A61H 2201/0173; A61H 2203/0406; A61H 2201/1635; A61H 2205/088; A61H 2205/081; A61H 2201/169; A61H 2203/0443; A61H 2201/1654; A61H 2201/1261; A61H 2015/0014
See application file for complete search history.

(56) References Cited

U.S. PATENT DOCUMENTS 2,829,891 A 4/1958 Ludwig
4,057,246 A 11/1977 Wilson
(Continued)

FOREIGN PATENT DOCUMENTS

CA 2551590 A6 1/2008
CA 202682654 A6 1/2013
(Continued)

*Primary Examiner* — Andrew S Lo

(57) ABSTRACT

A sleeve for a body roller has a main area, a first flap and a second flap. The main area has a first lateral side, a second lateral side, a first wrapping end, and a second wrapping end. The first flap is near the first lateral side and extends from the first wrapping end. The second flap is near the second lateral side and extends from either the first wrapping end or the second wrapping end. The main area has a length from the first wrapping end to the second wrapping end that is less than a circumference of the body roller such that when the sleeve is wrapped with the length oriented around the circumference of the body roller, an opening is formed between a first inner edge of the first flap and a second inner edge of the second flap.

19 Claims, 8 Drawing Sheets

(51) Int. Cl.
*A63B 1/00* (2006.01)
*A61H 15/00* (2006.01)

(52) U.S. Cl.
CPC ..... *A61H 2201/1623* (2013.01); *A61H 2201/1635* (2013.01); *A61H 2201/1654* (2013.01); *A61H 2201/1671* (2013.01); *A61H 2203/0406* (2013.01); *A61H 2203/0443* (2013.01); *A61H 2205/06* (2013.01); *A61H 2205/081* (2013.01); *A61H 2205/088* (2013.01); *A61H 2205/10* (2013.01)

(56) References Cited

U.S. PATENT DOCUMENTS 4,073,504 A 2/1978 Knapp
4,277,062 A 7/1981 Lawrence
4,378,009 A * 3/1983 Rowley ..... A61F 5/012 128/DIG. 20
5,139,476 A * 8/1992 Peters ..... A61F 5/0106 602/23
5,395,399 A * 3/1995 Rosenwald ..... A61F 5/0104 607/108
5,496,358 A * 3/1996 Rosenwald ..... A61F 5/0104 126/204
5,514,059 A 5/1996 Romney
5,569,137 A 10/1996 Uen
5,681,248 A 10/1997 Vani
5,697,962 A * 12/1997 Brink ..... A61F 7/02 126/204
5,810,700 A 9/1998 Orcutt
6,048,326 A * 4/2000 Davis ..... A61F 5/0106 602/26
D428,153 S * 7/2000 Davis ..... D24/190
D437,643 S * 2/2001 Davis ..... D24/190
6,244,998 B1 6/2001 Hinds
6,368,258 B1 4/2002 Emlaw
D478,996 S * 8/2003 Pace ..... D24/206
D479,864 S 9/2003 Maham
D484,986 S * 1/2004 Cipra ..... D24/206
6,740,008 B1 5/2004 Ho
D503,756 S 4/2005 Chiang
6,979,286 B1 12/2005 Hinds
D521,084 S 5/2006 Huang
7,674,216 B1 3/2010 Bolling
D626,243 S * 10/2010 Sagnip ..... D24/190
D662,213 S * 6/2012 Quisenberry ..... D24/206
D667,899 S 9/2012 Bronston et al.
2002/0143230 A1* 10/2002 Bove ..... A61N 2/06 600/9
2003/0204156 A1* 10/2003 Nelson ..... A61F 5/0106 602/26
2004/0110611 A1 6/2004 Huang
2004/0110613 A1 6/2004 Huang
2005/0107227 A1 5/2005 Massey
2005/0209074 A1 9/2005 Barrows
2007/0015644 A1 1/2007 Aucamp
2007/0066461 A1 3/2007 Carter et al.
2007/0087920 A1 4/2007 Dachraoui
2007/0207905 A1 9/2007 Winston
2009/0082183 A1 3/2009 Haynes
2010/0016134 A1 1/2010 Reese
2010/0204024 A1 8/2010 Mills et al.
2010/0255966 A1 10/2010 Aucamp
2010/0267529 A1 10/2010 Ayoub
2011/0218084 A1 9/2011 Doherty
2011/0251033 A1 10/2011 Blancher
2012/0115692 A1 5/2012 Bussen
2012/0322633 A1* 12/2012 Holman ..... A63B 21/028 482/123
2013/0324366 A1 12/2013 Pride
2014/0205640 A1* 7/2014 Harris ..... A47C 31/007 424/405
2014/0316314 A1* 10/2014 Schubert ..... A61H 9/0078 601/149
2015/0051523 A1* 2/2015 Lipshaw ..... A61F 13/085 601/84
2016/0166458 A9* 6/2016 Lipshaw ..... A61H 1/008 601/84
2016/0296364 A1* 10/2016 Gomez ..... A61F 7/02
2016/0310833 A1* 10/2016 Vu ..... A63F 3/00895
2017/0156479 A1* 6/2017 Kwong ..... A45F 4/02
2018/0125746 A1* 5/2018 Kokakis ..... A63B 21/0724
2018/0257832 A1* 9/2018 Loeffler ..... A45C 11/00
2018/0271688 A1* 9/2018 Miros ..... A61F 5/0106

FOREIGN PATENT DOCUMENTS

CA 203043405 A6 7/2013
CN 201135741 A6 10/2008
DE 29922904 A5 2/2000
FR 2839455 A6 11/2003
GB 2429176 A6 9/2005
JP 2008284330 A6 11/2008
KR 20120106138 A6 9/2012
WO WO2006017683 A6 2/2006
WO WO2009035604 A6 3/2009
WO WO2011005301 A6 1/2011
WO WO2012174553 A6 12/2012
WO WO2013001314 A6 1/2013
WO WO2013033757 A6 3/2013

* cited by examiner

BODY ROLLER SLEEVE

RELATED APPLICATIONS

This application claims priority to U.S. Provisional Patent Application No. 62/596,958 filed on Dec. 11, 2017 and entitled "Body Roller Sleeve/Cover," which is hereby incorporated by reference for all purposes.

BACKGROUND

Body rollers, also known as foam rollers, are commonly used in physical fitness activities for all parts of the body such as to assist in performing exercises, to aid in stretching, or to act as a massage device. The rollers are cylindrically shaped and can come in a variety of lengths depending on the use. Accessories for rollers include covers that are wrapped over the entire surface of the roller to provide a desired amount of cushioning or support and/or to provide texturing, such as to increase the amount of pressure for massage.

Resistance bands are also a popular type of exercise equipment that have been used in combination with support devices such as body rollers, exercise balls, and platforms on which a user can stand or lie down. For conventional devices that involve a body roller combined with a resistance band, the resistance band extends from the ends of the roller. For example, each end of the roller may have a resistance band attached to it, or a single band can be encased inside the roller, along the longitudinal axis, with the ends of the band extending out from the ends of the roller. In some devices, the tension of the resistance band is adjustable, such as by changing the length of the band.

SUMMARY

In some embodiments, a sleeve for a body roller has a main area, a first flap and a second flap. The main area has a first lateral side, a second lateral side opposite the first lateral side, a first wrapping end, and a second wrapping end opposite the first wrapping end. The first flap is near the first lateral side and extends from the first wrapping end. The second flap is near the second lateral side and extends from either the first wrapping end or the second wrapping end. The main area has a length from the first wrapping end to the second wrapping end that is less than a circumference of the body roller. When the sleeve is wrapped with the length oriented around the circumference of the body roller, an opening is formed between a first inner edge of the first flap and a second inner edge of the second flap.

In some embodiments, a method of applying a sleeve on a body roller includes providing the sleeve, placing a resistance band between the sleeve and the body roller, wrapping the sleeve onto the body roller, and securing a first flap and a second flap of the sleeve. The sleeve includes a main area, a first flap and a second flap. The main area has a first lateral side, a second lateral side opposite the first lateral side, a first wrapping end, and a second wrapping end opposite the first wrapping end. The first flap is near the first lateral side and extends from the first wrapping end. The second flap is near the second lateral side and extends from either the first wrapping end or the second wrapping end. The main area has a length from the first wrapping end to the second wrapping end that is less than a circumference of the body roller. When the sleeve is wrapped with the length oriented around the circumference of the body roller, an opening is formed between a first inner edge of the first flap and a second inner edge of the second flap. The resistance band is oriented around the circumference of the body roller. The sleeve is wrapped onto the body roller with the length of the sleeve oriented around the circumference of the body roller, and with the resistance band protruding through the opening and outward from the circumferential surface.

DETAILED DESCRIPTION

The present embodiments disclose a sleeve for a body roller that enables a resistance band to be coupled to the body roller, where the resistance band extends from a circumferential surface from the body roller rather than from the axial ends as in conventional devices. This orientation of having the resistance band extend radially from the body roller provides health benefits, such as improving posture during resistance training and enabling different exercises to be performed that are not possible with devices in which resistance bands are in the axial orientation. Additionally, the sleeve improves ease of use and reduces cost by allowing any body roller to be converted into a combination device with a resistance band, rather than requiring a user to purchase a specialized device in which the resistance band is permanently incorporated into the exercise apparatus as is the case with existing roller/resistance band combination devices. The sleeve of the present disclosure also enables combination resistance band/body roller exercises to be performed easily at home. The combination of the body roller and the safety sleeve/cover works like an anchor for the resistance band, enabling the resistance band to be safely used. The user benefits from the resistance band as an effective tool for strengthening muscles of the upper and lower body without having concerns over the risk of injuries from the resistance band snapping onto their body parts.

In this disclosure the sleeve may also be referred to as a wrap or a cover; the body roller may also be referred to as a roller; and the resistance band may also be referred to as an elastic band or a band.

Figure 1A:
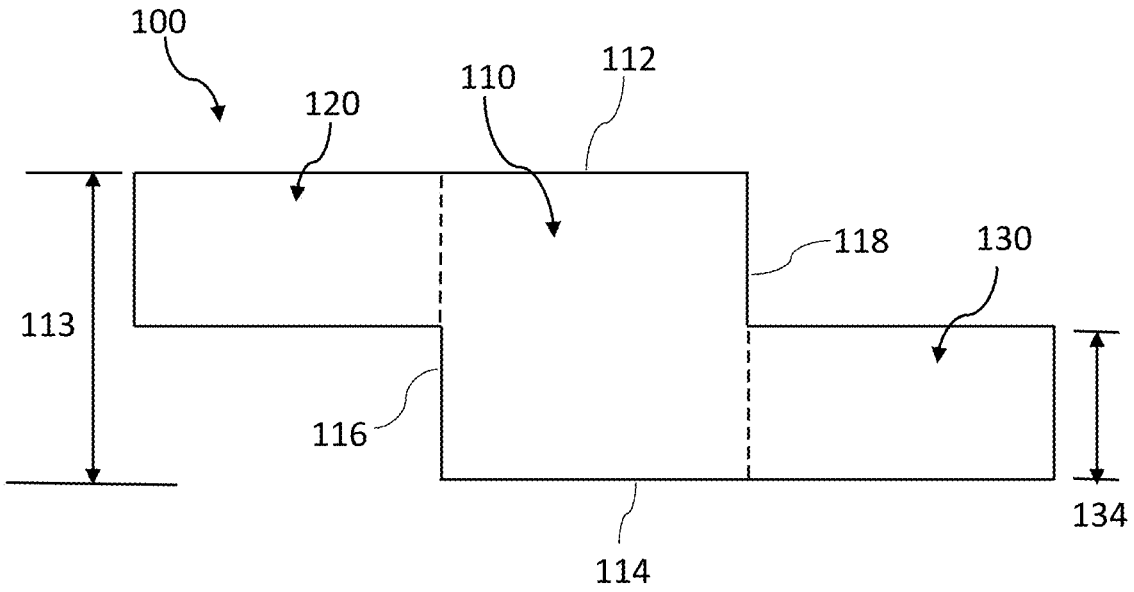
FIG. 1A is a top view of a sleeve for a body roller, in accordance with some embodiments.

FIG. 1A shows a top view of a sleeve 100 for a body roller, in accordance with some embodiments. The sleeve 100 is a flexible piece of material, such as a fabric, polymer or composite material (e.g., polymer or fabric with fiber reinforcements). The sleeve 100 includes a main area 110, a first flap 120 and a second flap 130. The main area 110 has a first lateral side 112, a second lateral side 114 opposite the first lateral side 112, a first wrapping end 116 and a second wrapping end 118 opposite the first wrapping end 116. A main width 113 of the sleeve, from the first lateral side 112 to the second lateral side 114, may be less than a length of the body roller. That is, the sleeve 100 may cover only a portion of or up to all of the circumferential surface of the body roller.

Each flap 120 and 130 is a portion of the sleeve 100 that has a width (e.g., width 134 of second flap 130) that is less than the main width 113 of the main area, such as equal to or less than half the width of the main area. The widths of the first and second flaps 120 and 130 may be the same or different from each other. The first flap 120 is near the first lateral side 112 and extends from the first wrapping end 116 of the main area 110. The second flap 130 is near the second lateral side 114 and may extend from either the first wrapping end 116 or the second wrapping end 118. In the embodiment of FIG. 1A, the second flap 130 extends from the second wrapping end 118 such that the second flap 130 is diagonally opposite from the first flap 120. The flaps 120 and 130 generally extend perpendicular to the wrapping ends 116 and 118. The flaps 120 and 130 are shown to be rectangular in FIG. 1A but may take the form of other shapes such as having rounded corners, tapering away from the main area 110, or having curved edges.

The first flap 120 and second flap 130 are shown to be integral in the embodiment of FIG. 1A, being made of one piece of material with the main area 110. In other embodiments, the first flap 120 and/or the second flap 130 may be separate pieces that are attached to the main area 110 and may be of the same or a different material than the main area 110. In further embodiments, the main area 110, first flap 120, and second flap 130 may be modular such that the flaps or main areas may be provided in varying dimensions or material constructions, so that they may be interchangeable with each other in different combinations to accommodate different exercise situations. For example, body rollers of different dimensions may be required when using the body roller between the legs versus under the back when lying on the ground. In such a scenario, a user may employ one sleeve configuration in one situation and then switch to a larger or smaller-sized main area or to different length flaps in the next situation. In another example, a user may desire more cushioning when sitting on the body roller compared to when using the body roller under their feet. In this example, a main area having a firmer or softer padding may be switched out to use with the same flaps.

In some embodiments, the sleeve may be made of a material that has one or more of the following characteristics: being washable, having a non-slip surface, and providing cushioning. For example, the sleeve may be made of neoprene, such as a non-latex neoprene. In some embodiments, the material for the sleeve may have multiple layers, such as one or more of an anti-microbial layer, a moisture-wicking layer, a padded layer, and a grippable layer (e.g., a non-slip material on a surface of the sleeve that will face the body roller and/or on an opposite surface that will be placed against the user's skin).

Figure 1B:
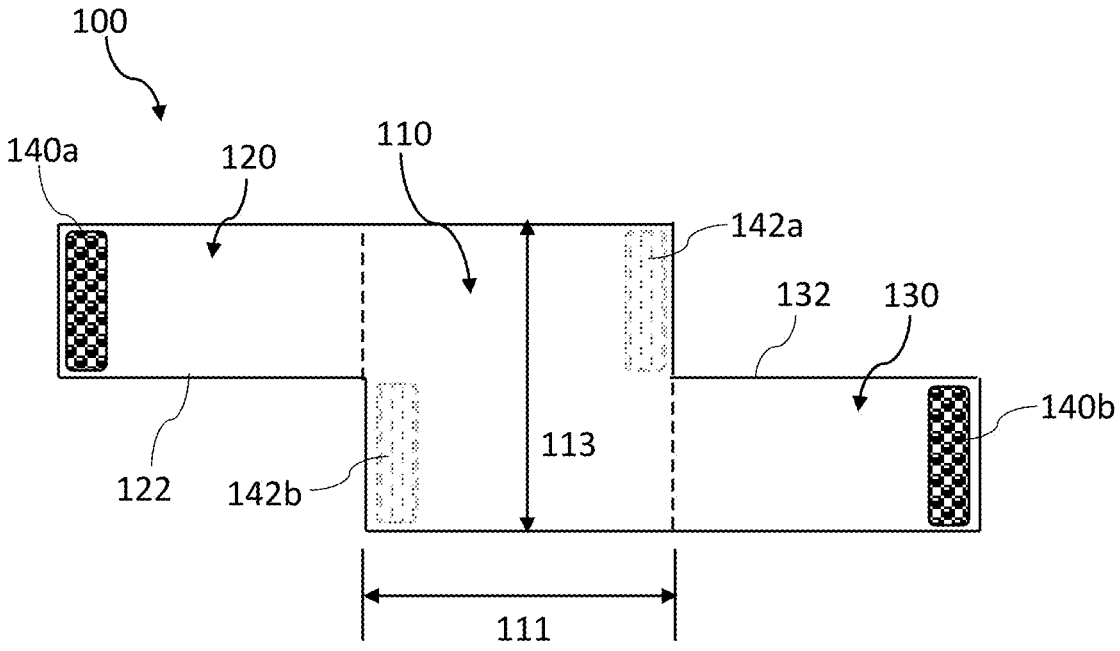
FIG. 1B is another top view of the sleeve of FIG. 1A.

FIG. 1B shows additional aspects of the sleeve 100, in accordance with some embodiments. The main area 110 has a length 111 from the first wrapping end 116 to the second wrapping end 118. When applied to a body roller, sleeve 100 will be wrapped with the length oriented around a circumference of the body roller. The length 111 is sized to be less than the circumference of the body roller such that when the sleeve is secured on the body roller, an opening is formed between a first inner edge 122 of the first flap 120 and a second inner edge 132 of the second flap 130. The opening uniquely enables a resistance band to be wrapped transversely (i.e., circumferentially) around the body roller and extend from the curved surface of the roller rather than extending from the axial ends as in conventional combination resistance band/roller devices.

The sleeve 100 may be secured onto a body roller by, for example, a fastener. In the embodiment of FIG. 1B, the fastener is a hook-and-loop type, where a first fastener includes a first component 140*a* (e.g., the hook side) and a second component 142*a* (e.g., the loop side) that receives the first component 140*a*. Similarly, a second fastener includes a first component 140*b* and a second component 142*b* that receives the first component 140*b*. The first components 140*a/b* of the fasteners are on the first flap 120 and second flap 130, respectively, where the top view in FIG. 1B shows the surface of the sleeve 100 that will be placed against the body roller. The second components 142*a/b* of the fasteners are on the opposite surface of the sleeve 100, that will face outwardly from the roller. The first fastener (components 140*a*, 142*a*) secures the first flap 120 to the sleeve 100 when the main area 110 is wrapped around the body roller, with the first lateral 112 end facing an end of the body roller. The second fastener (components 140*b*, 142*b*) secures the second flap 130 to the sleeve 100 when the main area is wrapped around the body roller. In FIG. 1B, the receiving fastener components 142*a/b* are shown to be positioned at the wrapping ends 116 and 118 of the main area 110 but may be positioned away from (i.e., spaced apart from) the ends 116 and 118 in other embodiments. Furthermore, the fastener components 140*a/b* and 142*a/b* are shown as strips in this embodiment but may have larger surface areas in other embodiments. For example, larger surface areas may allow adjustability in the amount of overlap of the flaps 120 and 130 onto the main area 110, such as to accommodate body rollers of different diameters or to accommodate different thicknesses of resistance bands that will be retained between the sleeve 100 and the body roller.

Although FIG. 1B illustrates a hook-and-loop type fastener, other types of releasable fasteners may be used to enable the sleeve to be easily installed and removed from a body roller, such as snaps, buttons, straps, buckles and the like. The fasteners may include multiple sets of fastening components, such as multiple sets of receiving components on main area 110, where the receiving components are spaced at increments to enable the sleeve 100 to have different diameters or levels of tightness when wrapped onto a roller. Additionally, although the fasteners are included on the sleeve in FIG. 1B, in other embodiments the fasteners may be a separate component from the sleeve. For example, the sleeve 100 may not have fasteners incorporated onto the sleeve but may be provided with separate fasteners such as a clip or a latching pin to use with the sleeve. In yet other embodiments, more than one fastener may be used for each flap, or one fastener may be used to secure both flaps at the same time. In yet further embodiments, the flaps need not overlap the main area of the sleeve to be fastened but may abut or nearly abut the main area. For example, the end of flap 120 can be secured to the wrapping edge 118 by mating fasteners that are at the end of the flap and at the wrapping edge 118.

Figure 2:
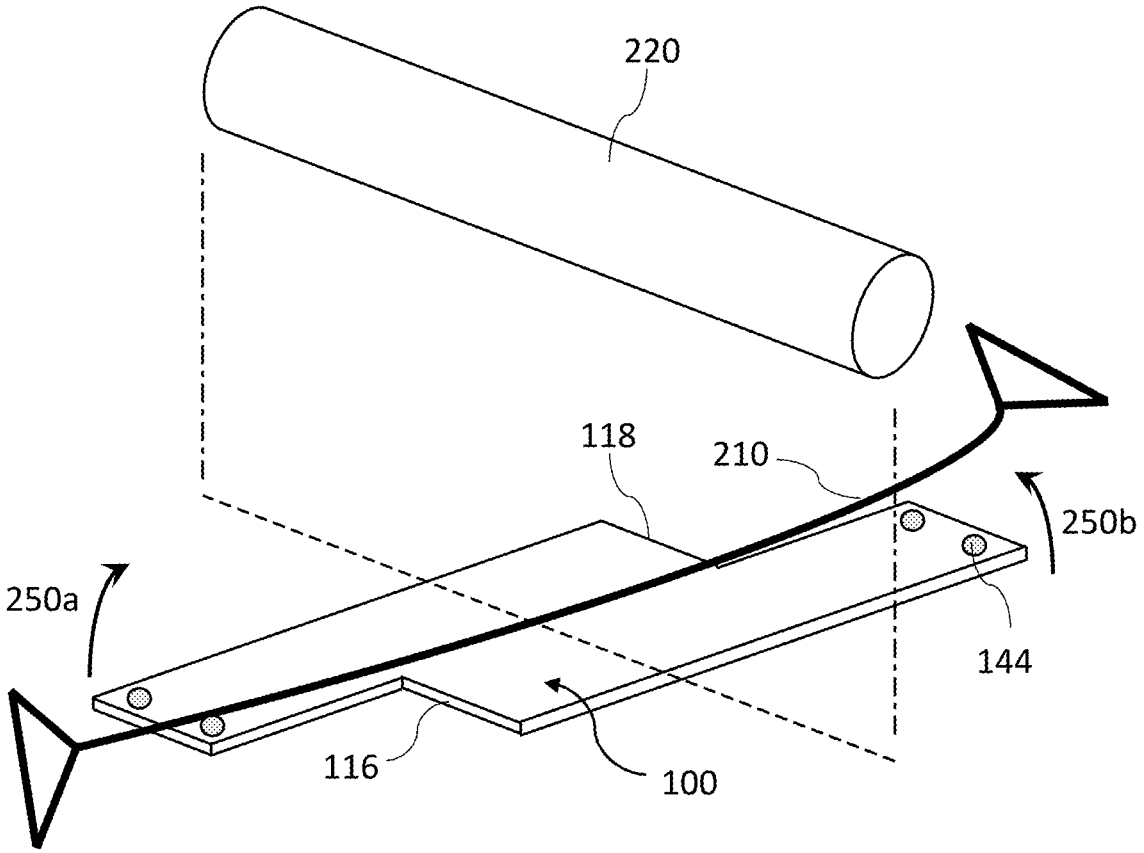
FIG. 2 is an exploded perspective view of an exercise equipment system including a sleeve, a resistance band and a body roller, in accordance with some embodiments.
Figure 3:
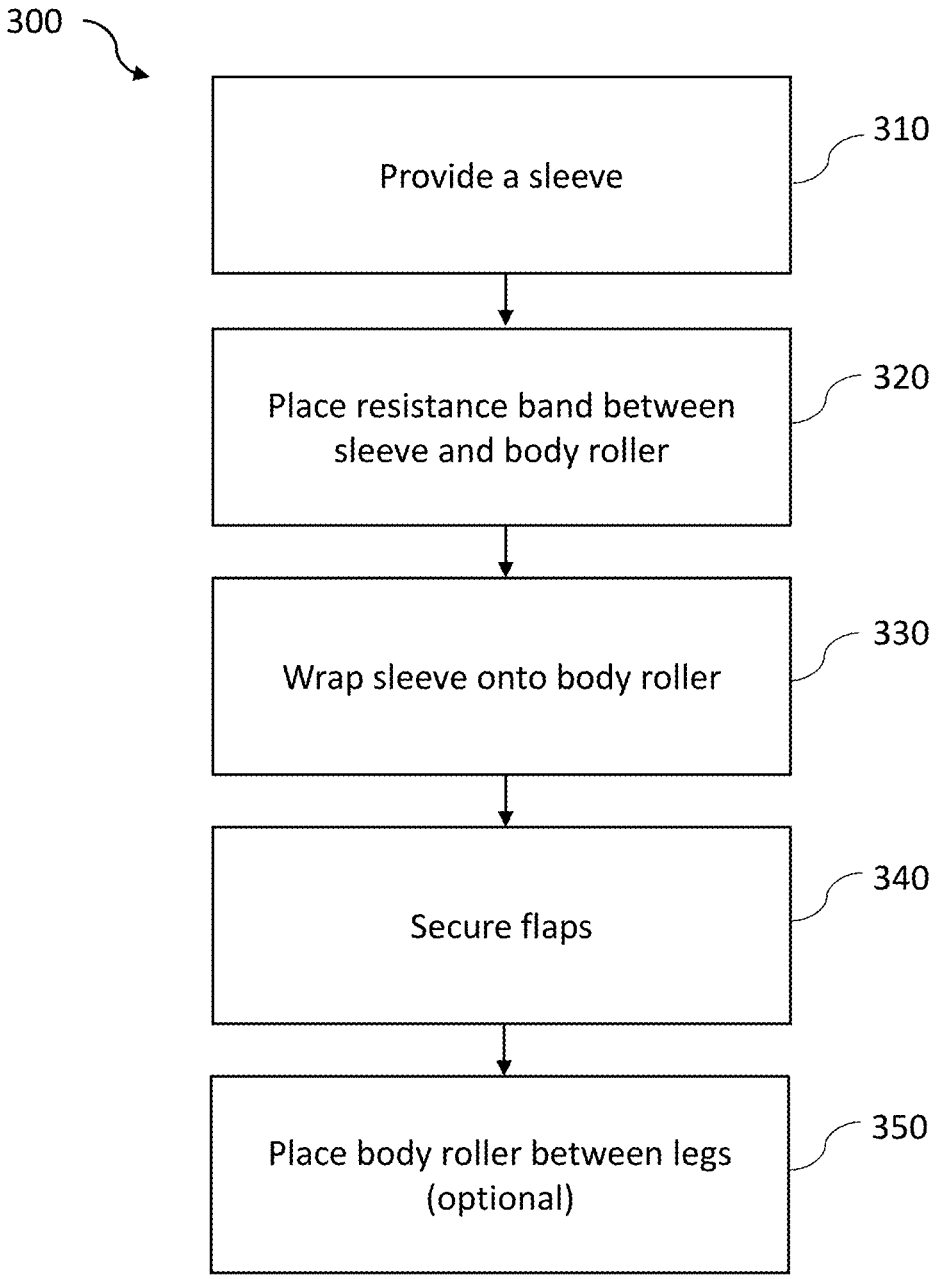
FIG. 3 is a method of placing a sleeve on a body roller, in accordance with some embodiments.

FIG. 2 shows the sleeve 100 being used to couple a resistance band 210 to a body roller 220, as also represented in the method 300 of applying a sleeve on a body roller of FIG. 3. Step 310 involves providing the sleeve 100. In step 320, resistance band 210 is placed between the sleeve 100 and the body roller 220, where the resistance band 210 is oriented around the circumferential of the body roller 220. That is, the resistance band 210 is laid in a direction extending from the first wrapping end 116 to the second wrapping end 118. In step 330, the sleeve 100 is wrapped onto the body roller 220 as indicated by arrows 250*a* and 250*b* in FIG. 2. In some embodiments of steps 320 and 330, the resistance band 210 may be first laid into the sleeve 100 in the direction of the flaps and near the inner edges of the flaps (edges 122, 132 of FIG. 1B), and then the sleeve 100 with band 210 are wrapped around the body roller 220. In other embodiments, the band 210 may be first placed around the roller 220 and then the sleeve 100 placed over the band 210 and roller 220, with band 210 protruding from between the flaps. The presence of the sleeve 200 over the band 210 tightens the securing of the band 210 against roller 220. In some embodiments, step 320 of placing the resistance band 210 between the sleeve and the body roller may involve tying the resistance band onto the body roller. For example, the band 210 may be looped once around the roller and tied in a basic knot prior to or after the sleeve is placed over the resistance band. The sleeve helps prevent the resistance band from sliding off of the roller when the band is being pulled during physical training. Without the sleeve present, the resistance band can slide off even if it is tied onto the roller.

As can be seen in FIG. 2, the resistance band 210 is an individual device separate from the body roller 220, enabling a user to easily interchange bands such as for different lengths and different tensions as desired. Additionally, a user can use any roller and any resistance band that they already own and convert their equipment into a combination device, where the sleeve 100 securely and safely holds the band in place on the roller.

Figure 4:
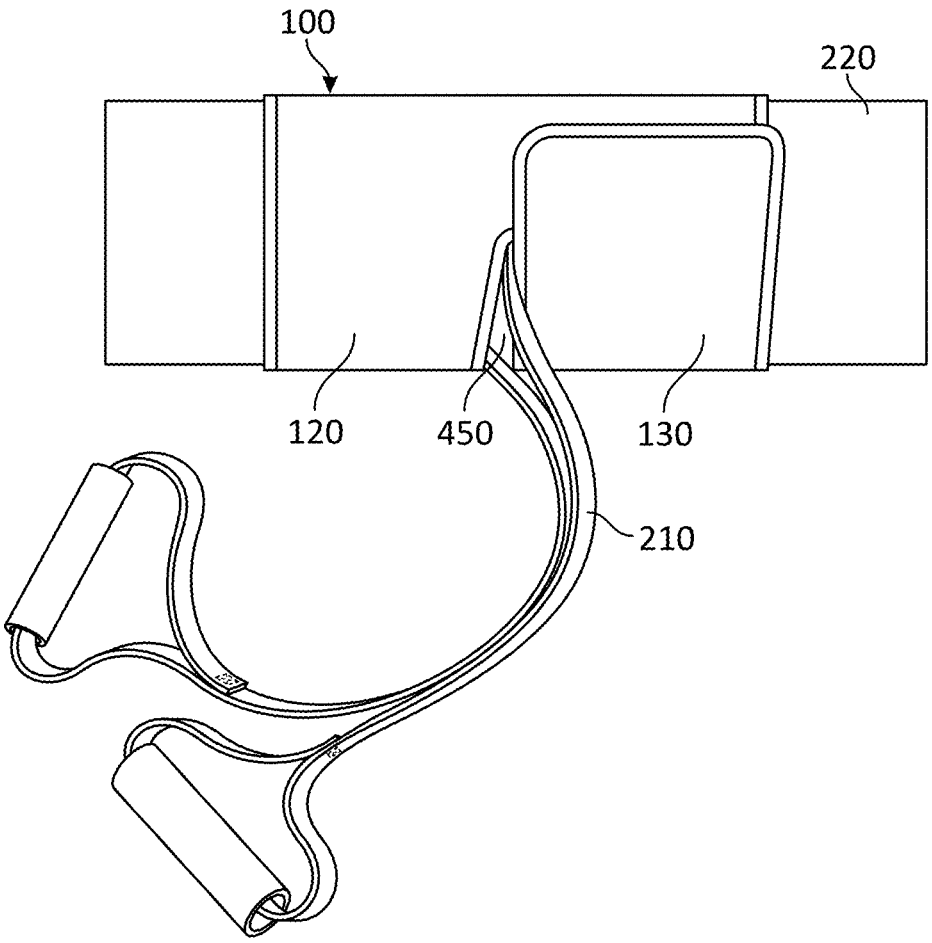
FIG. 4 is a top view of an assembled system of a sleeve, a resistance band and a body roller, in accordance with some embodiments.

FIG. 4 shows the assembled system with the sleeve 100 secured onto the body roller 220 and stably retaining the resistance band 210 on the body roller 220. The sleeve 100 is wrapped around the circumference of the roller 220, forming a sleeve. The sleeve 100 covers a portion of the length of the body roller 220 in this embodiment (e.g., approximately half), but can cover less (e.g., less than half) or up to the entire length of the body roller in other embodiments. As can be seen in FIG. 4, the resistance band 210 protrudes outward from the circumferential surface of the body roller 220, through an opening 450 formed between first flap 120 and second flap 130. The opening is created because the main area 110 (FIG. 1A) does not extend around the entire circumference of the body roller 220. The opening 450 between the flaps 120 and 130 uniquely enables a resistance band to be utilized around the diameter of the roller instead of axially as in conventional devices. Furthermore, because the sleeve 100 is a separate component from the band 210 and the roller 220, the sleeve 100 is adaptable to existing equipment that a user might already own, rather than requiring the user to purchase and store a specialized device in which a resistance band is built into a roller.

Returning to FIG. 3, step 340 of method 300 involves securing the first flap and the second flap to the sleeve, such as by fasteners 144 which are embodied as snaps or buttons in FIG. 3. In some embodiments the securing of the flaps may involve coupling the components 140*a* and 142*a* (FIG. 1B) of the first fastener together (e.g. by pressing hook-and-loop fasteners together) and the components 140*b* and 142*b* of the second fastener together. The assembly of the roller 220, resistance band 210 and sleeve 100 may be then utilized for physical activity. In some embodiments, the method 300 involves step 350 of placing the assembled body roller between the legs of a user, such as to exercise a user's arms, core and/or back. When placed between the legs, the body roller may have a diameter of less than or equal to 6 inches and may be positioned such that a longitudinal axis of the body roller is in a front-to-back orientation relative to the user.

Figure 5:
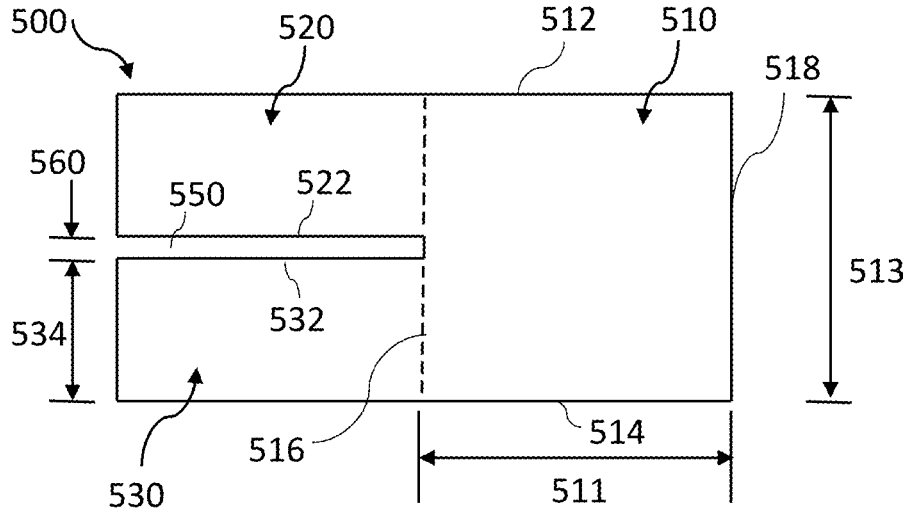
FIG. 5 is a top view of another embodiment of a sleeve.

FIG. 5 shows another embodiment of a sleeve 500 in which a first flap 520 and a second flap 530 extend from the same edge of a main area 510. In this top view, main area 510 has a first lateral side 512, a second lateral side 514 opposite the first lateral side 512, a first wrapping end 516 and a second wrapping end 518 opposite the first wrapping end 516. The main area 510 has a length 511 from the first wrapping end 516 to the second wrapping end 518 that is tailored to be less than a circumference of a body roller with which the sleeve 500 will be used. The first flap 520 is near the first lateral side 512 and extends from the first wrapping end 516. The second flap 530 is near the second lateral side 514 and also extends from the first wrapping end 516. An opening 550 is formed between the first inner edge 522 of first flap 520 and the second inner edge 532 of second flap 530. In this embodiment, the opening 550 has a gap 560 that is greater than zero between the first inner edge 522 and the second inner edge 532; that is, the opening has a physical distance between the flaps 520 and 530. In other embodiments, the inner edges 522 and 532 can be adjacent and there need not be a physical gap (i.e., gap 560 equals zero), where the opening 550 is created by virtue of the flaps 520 and 530 being separate pieces. The flap 530 has a width 534 that is less than a main width 513 of the main area 510, such as less than half of the main width 513 depending on the width of gap 560. The first flap 520 and second flap 530 are shown to be symmetrical in shape and size to each other in this embodiment but may be asymmetrical in other embodiments.

Figure 6:
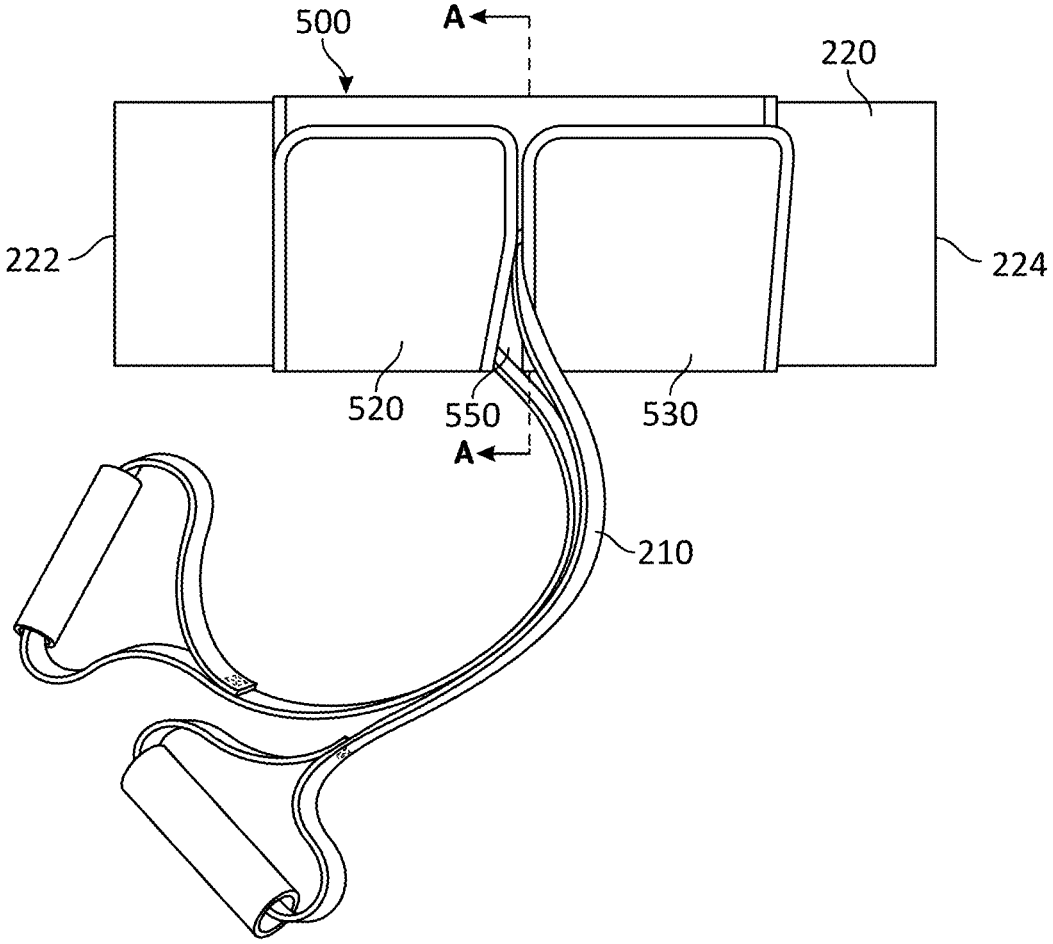
FIG. 6 is a top view of the sleeve of FIG. 6, assembled with a body roller and a resistance band, in accordance with some embodiments.

FIG. 6 shows the sleeve 500 secured onto body roller 220 to hold resistance band 210 in place to be used in combination with the body roller 220. As can be seen in FIG. 6, the flaps 520 and 530 are wrapped in the same direction (upward in this illustration) rather than opposite directions as in FIG. 4. Either type of flap arrangement of sleeve 500 and sleeve 100 can provide secure retainment of the resistance band. Both FIGS. 4 and 6 show that the sleeves of the present disclosure enable a resistance band to be oriented transversely to body roller rather than extending from the axial ends 222 and 224 (FIG. 6) of the body roller 220, enabling different types of exercise than are possible with axially-configured bands.

Figure 7:
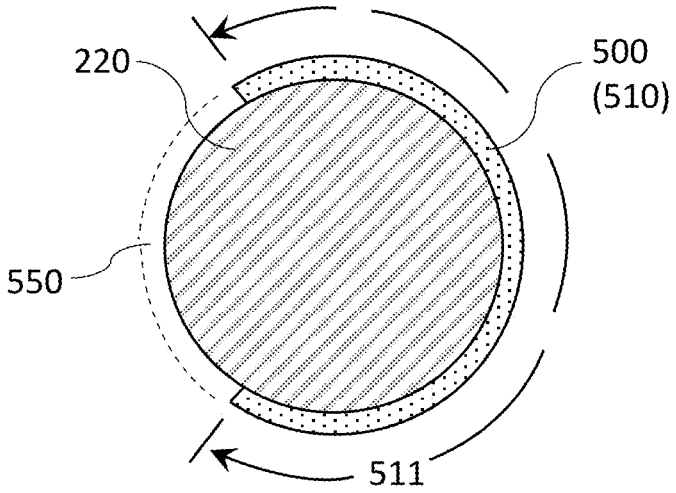
FIG. 7 is a cross-sectional view of a sleeve on a body roller, in accordance with some embodiments.

FIG. 7 is a cross-sectional view of section A-A from FIG. 5, illustrating how the sleeves of the present disclosure provide an opening for the resistance bands. In FIG. 7 the body roller 220 and sleeve 500 are shown, where the cross-section A-A is taken across the diameter of the body roller 220 and where the opening 550 is located. As can be seen, the length 511 of the main area 510 of the sleeve 500 covers less than the circumference of the body roller 220, therefore forming the opening 550 in combination with the gap between the first and second flaps (not shown). In some embodiments, the length 511 of the main area 510 may be less than 95% of the circumference of the roller 220, such as less than 75%, or less than 60%; or may be from 40% to 95% of the circumference, such as from 50% to 80% or from 40% to 60%. The opening 550 may extend partially around the circumference of the body roller, such as to form an elongated slot. In some embodiments, the opening may extend from 5% to 60% around the circumference, or from 20% to 50%, or from 40% to 60%. The length of the opening around the circumference enables freedom of movement of the resistance bands during use, such as in angular directions, where a longer opening may enable a greater degree of movement for certain exercises.

Figure 8:
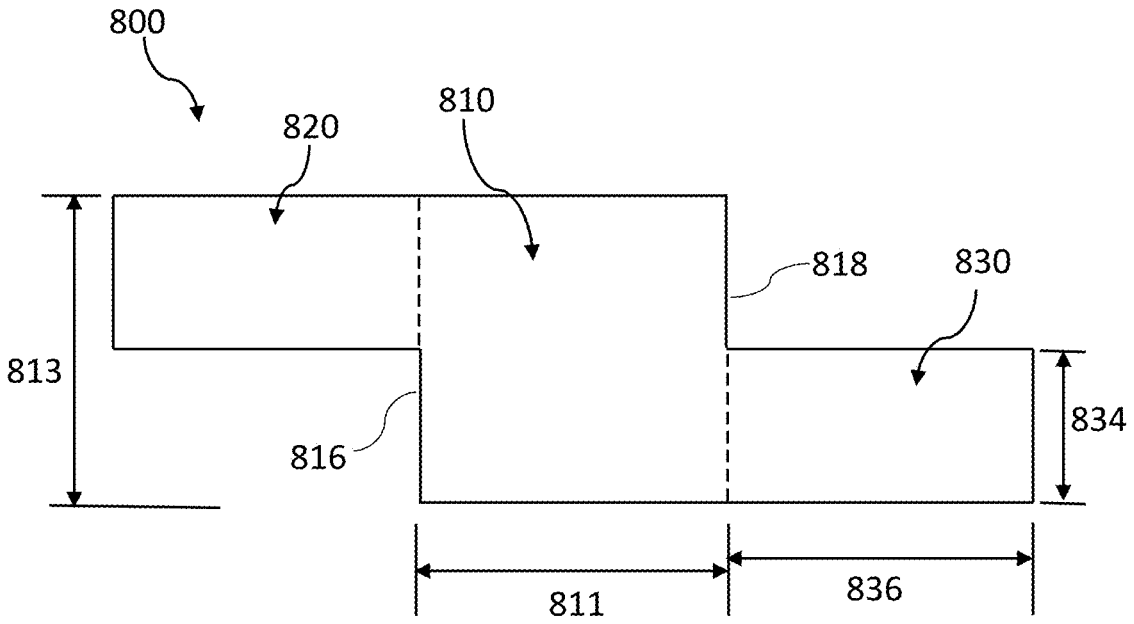
FIG. 8 is a top view showing example dimensions of a sleeve, in accordance with some embodiments.

FIG. 8 shows an embodiment of a sleeve 800 that is dimensioned for a body roller having a diameter of approximately 5 inches to 6 inches, such as between 5.5 to 5.75 inches. Such a body roller may be particularly suitable for placement between a person's legs, such as between their thighs. Sleeve 800 has a main area 810, a first flap 820 and a second flap 830. The main area 810 has a length 811 between a first wrapping end 816 and a second wrapping end 818, where the length 811 may be, for example, less than 15 inches, such as from 8 inches to 12 inches, such as approximately 10 inches. A main width 813 of the main area 810 may be, for example, from 8 inches to 12 inches, such as approximately 10 inches. Each flap 820 and 830 may have a width 834 of, for example 4 inches to 6 inches, such as approximately 5 inches; and a length 836 of, for example, 8 inches to 12 inches, such as approximately 10 inches. The dimensions of first flap 820 may the same or different as second flap 830.

Without the sleeve, the resistance band can easily slide off of the roller (e.g., from the ends of the roller or from around the diameter) which poses a risk of injury. The sleeves of the present disclosure hold the elastic band safely around the roller, enabling the resistance band to be pulled with full strength during exercising to work out the muscles of the entire body including, but not limited to, the arms, shoulders, back and legs. The sleeve holds the elastic band securely so that a full power workout can be performed with reduced chances of the injury from the elastic band being accidentally released from the body roller.

Figure 9A:
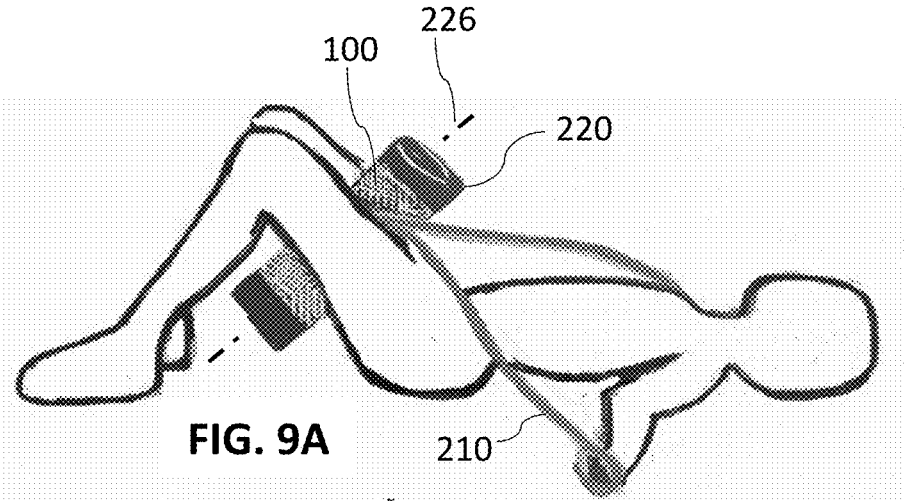
FIGS. 9A-9B are side views of a sleeve in a body roller/resistance band system in operation by a user, in accordance with some embodiments.
Figure 9B:
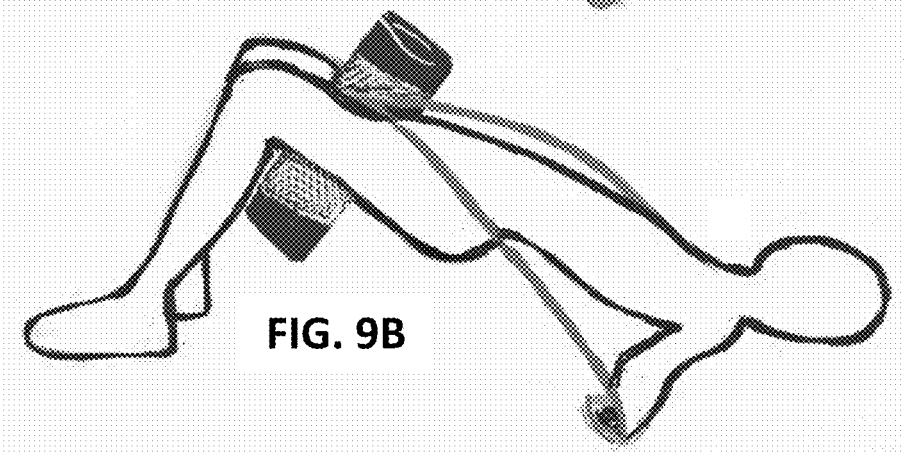
Figure 10:
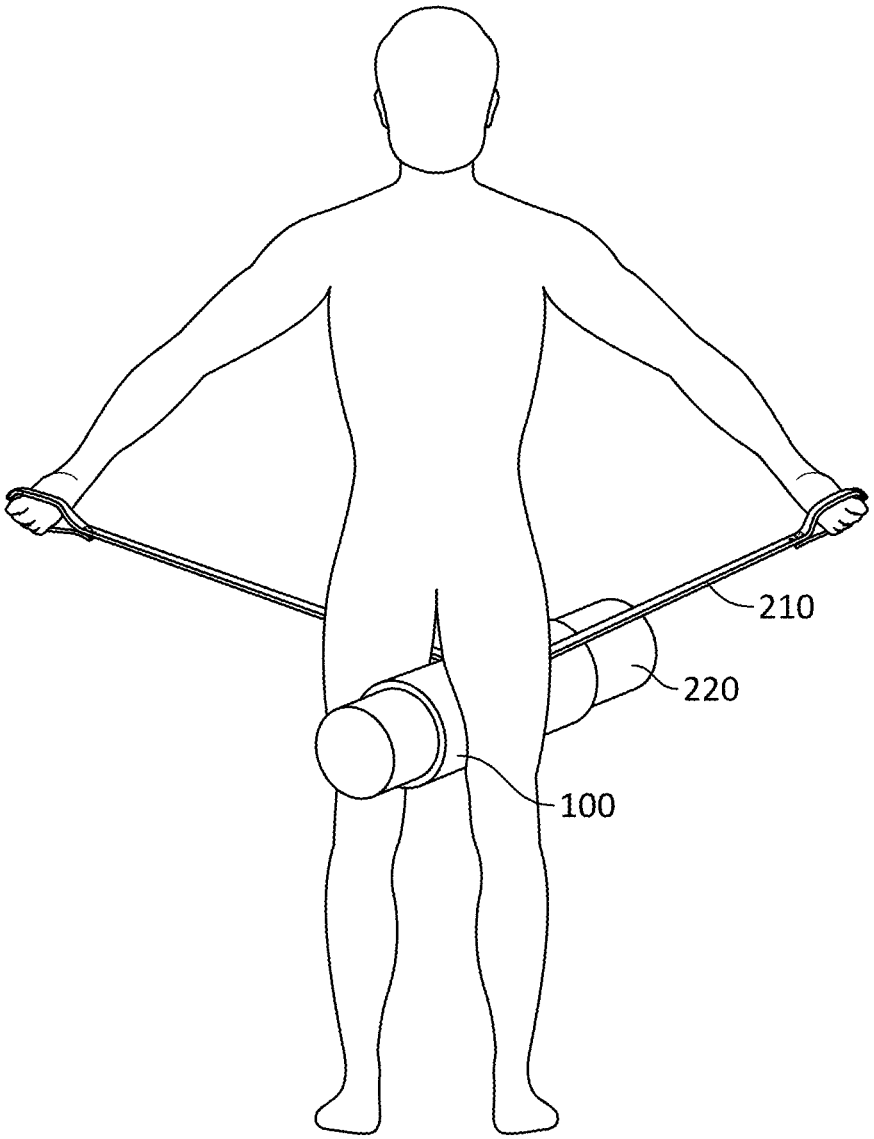
FIG. 10 is a front view of a sleeve in a body roller/resistance band system in operation by a user, in accordance with some embodiments.

In some embodiments, the roller is placed between the legs to keep the legs apart for good posture and for working out the muscles by pressing them on the body roller. For example, the body roller keeps the spine straightened while exercising lying down on the floor as shown in FIGS. 9A-9B or standing upright as shown in FIG. 10. In FIGS. 9A-9B and FIG. 10, the longitudinal axis 226 of the body roller 220 is in a front-to-back orientation relative to the user. The roller 220 may have a diameter of approximately 6 inches, such as 5.5 inches or 5.75 inches. Having good body posture during exercise can be challenging, requiring extensive training and practice. Maintaining good posture during resistance training allows the muscles to operate at maximum efficiency and the joints to be aligned properly, thus enabling a person to exercise more intensely and to prevent injury. While the body roller keeps the spine in a neutral position, pressing on the roller tightens the buttocks to support the lower back. This is the most effective way for training the spine to have a neutral position as the central point of the body, to bring the other parts of the body into a proper posture.

The sleeve may include additional features to enhance exercising. For example, in some embodiments the sleeve may include a pocket to hold a fitness tracking device, such as a pedometer or a smartphone, to count the number of repetitions performed with the resistance band during training. The pocket may be on the surface of the sleeve that faces outward from the body roller and may be positioned on one of the flaps of the sleeve or on the main area.

Reference has been made to embodiments of the disclosed invention. Each example has been provided by way of explanation of the present technology, not as a limitation of the present technology. In fact, while the specification has been described in detail with respect to specific embodiments of the invention, it will be appreciated that those skilled in the art, upon attaining an understanding of the foregoing, may readily conceive of alterations to, variations of, and equivalents to these embodiments. For instance, features illustrated or described as part of one embodiment may be used with another embodiment to yield a still further embodiment. Thus, it is intended that the present subject matter sleeves all such modifications and variations within the scope of the appended claims and their equivalents. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed is:

1. A sleeve for a body roller, the sleeve comprising:

a main area having a first lateral side, a second lateral side opposite the first lateral side, a first wrapping end, and a second wrapping end opposite the first wrapping end;

a first flap extending from an edge outward from the first lateral side, the first flap being rectangular in shape having a length between 8 inches to 12 inches and extending from the first wrapping end; and a second flap extending from an edge outward from the second lateral side, the second flap being rectangular in shape having a length between 8 inches to 12 inches and extending from the second wrapping end;

wherein the main area has a length from the first wrapping end to the second wrapping end that is from 8 inches to 12 inches for the body roller having a diameter of 5 to 6 inches, wherein when the sleeve is wrapped with the length oriented around a circumference of the body roller, an opening is formed between a first inner edge of the first flap and a second inner edge of the second flap, and the first inner edge is adjacent to the second inner edge.

2. The sleeve of claim 1 wherein:

the main area has a main width from the first lateral side to the second lateral side; and the first flap has a first width that is less than the main width.

3. The sleeve of claim 1 wherein the main area has a main width from the first lateral side to the second lateral side that is less than a length of the body roller.

4. The sleeve of claim 1 further comprising:

a first fastener that secures the first flap to the sleeve when the main area is wrapped around the body roller with the first lateral end facing an end of the body roller; and a second fastener that secures the second flap to the sleeve when the main area is wrapped around the body roller.

5. The sleeve of claim 1, wherein the opening enables a resistance band to protrude through the opening and outward from a circumferential surface of the body roller.

6. The sleeve of claim 1 wherein the opening is an elongated slot that extends at least partially around the circumference of the body roller.

7. A method of applying a sleeve on a body roller, the method comprising:

i) providing the sleeve, the sleeve comprising:

a main area having a first lateral side, a second lateral side opposite the first lateral side, a first wrapping end and a second wrapping end opposite the first wrapping end;

a first flap near the first lateral side and extending from the first wrapping end; and a second flap near the second lateral side and extending from either the first wrapping end or the second wrapping end;

wherein the main area has a length from the first wrapping end to the second wrapping end that is less than a circumference of the body roller, wherein when the sleeve is wrapped with the length oriented around the circumference of the body roller, an opening is formed between a first inner edge of the first flap and a second inner edge of the second flap;

ii) placing a resistance band between the sleeve and the body roller, wherein the resistance band is oriented around the circumference of the body roller;

iii) wrapping the sleeve onto the body roller with the length oriented around the circumference of the body roller, and with the resistance band protruding through the opening and outward from the circumferential surface; and iv) securing the first flap and the second flap to the sleeve.

8. The method of claim 7 further comprising:

v) placing the body roller, with the sleeve and the resistance band secured on the body roller, between the legs of a user, wherein:

a longitudinal axis of the body roller is in a front-to-back orientation relative to the user; and the body roller has a diameter of less than or equal to 6 inches.

9. The method of claim 7 wherein placing the resistance band between the sleeve and the body roller comprises tying the resistance band onto the body roller.

10. The method of claim 7 wherein the first flap has a first width that is less than a width of the main area, wherein the width of the main area is from the first lateral side to the second lateral side.

11. The method of claim 7 wherein the opening is an elongated slot that extends at least partially around the circumference of the body roller.

12. A system comprising:

i) a body roller having a diameter of 5 to 6 inches;

ii) a resistance band; and iii) a sleeve comprising:

a main area having a first lateral side, a second lateral side opposite the first lateral side, a first wrapping end, and a second wrapping end opposite the first wrapping end;

a first flap near the first lateral side and extending from the first wrapping end; and a second flap near the second lateral side and extending from either the first wrapping end or the second wrapping end;

wherein the main area has a length from the first wrapping end to the second wrapping end that is less than a circumference of the body roller, wherein when the sleeve is wrapped with the length oriented around the circumference of the body roller, an opening is formed between a first inner edge of the first flap and a second inner edge of the second flap.

13. The system of claim 12 wherein the length of the main area is 8 to 12 inches.

14. The system of claim 12 wherein the first flap and the second flap are rectangular in shape.

15. The system of claim 12 wherein the second flap extends from the second wrapping end.

16. The system of claim 12 wherein the sleeve further comprises:

a first fastener that secures the first flap to the sleeve when the main area is wrapped around the body roller with the first lateral end facing an end of the body roller; and a second fastener that secures the second flap to the sleeve when the main area is wrapped around the body roller.

17. The system of claim 12 wherein when the resistance band is placed between the sleeve and the body roller, and the sleeve is wrapped with the length oriented around the circumference of the body roller, the resistance band protrudes through the opening and outward from a circumferential surface of the body roller.

18. The system of claim 12 wherein the opening is an elongated slot that extends at least partially around the circumference of the body roller.

19. The system of claim 12 wherein the first inner edge is adjacent to the second inner edge when the sleeve is wrapped around the circumference of the body roller.

* * * * *